United States Patent [19]

Hor et al.

[11] Patent Number: 4,587,189

[45] Date of Patent: May 6, 1986

[54] PHOTOCONDUCTIVE IMAGING MEMBERS WITH PERYLENE PIGMENT COMPOSITIONS

[75] Inventors: Ah-Mee Hor, Mississauga; Rafik O. Loutfy, Willowdale, both of Canada

[73] Assignee: Xerox Corporation, Stamford, Conn.

[21] Appl. No.: 737,605

[22] Filed: May 24, 1985

[51] Int. Cl.[4] ..... G03G 5/14

[52] U.S. Cl. ..... 430/59; 430/78

[58] Field of Search ..... 430/59, 78

*Primary Examiner*—John D. Welsh

*Attorney, Agent, or Firm*—E. O. Palazzo

[57] ABSTRACT

Disclosed is an improved layered photoresponsive imaging member comprised of a supporting substrate; a vacuum evaporated photogenerator layer comprised of a perylene pigment selected from the group consisting of a mixture of bisbenzimidazo(2,1-a-1',2'-b)anthra(2,1,9-def:6,5,10-d'e'f')diisoquinoline-6,11-dione, and bisbenzimidazo(2,1-a:2',1'-a)anthra(2,1,9-def:6,5,10-d'e'f')diisoquinoline-10,21-dione, and N,N'-diphenyl-3,4,9,10-perylenebis(dicarboximide); and an aryl amine hole transport layer comprised of molecules of the following formula:

dispersed in a resinous binder and wherein X is selected from the group consisting of halogen and alkyl.

24 Claims, 5 Drawing Figures

PHOTOCONDUCTIVE IMAGING MEMBERS WITH PERYLENE PIGMENT COMPOSITIONS

BACKGROUND OF THE INVENTION

This invention is generally directed to photoresponsive imaging members, and more specifically the present invention is directed to layered photoresponsive members having incorporated therein certain perylene pigment compositions. Thus, in one embodiment the present invention envisions the use of specific pigment compositions as organic photogenerator materials in photoresponsive imaging members containing therein arylamine hole transport molecules. The aforementioned photoresponsive imaging members can be negatively charged when the perylene photogenerating layer is situated between the hole transport layer and the substrate; or positively charged when the hole transport layer is situated between the photogenerating layer and the supporting substrate. Additionally, the photoresponsive imaging members with the perylene pigment compositions as photogenerator substances, and wherein the member further includes therein an aryl amine hole transport layer are useful in electrophotographic imaging processes, especially xerographic processes wherein negatively charged or positively charged images are rendered visible with developer compositions of the appropriate charge.

Layered photoresponsive imaging members are generally known, reference for example U.S. Pat. No. 4,265,900, the disclosure of which is totally incorporated herein by reference, wherein there is described an imaging member comprised of a photogenerating layer, and an aryl amine hole transport layer. Examples of substances useful in the photogenerating layer of this patent include trigonal selenium, metal phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles. Accordingly, as a result the photoconductive particles must be in a substantially contiguous particle-to-particle contact throughout the layer for the purpose of permitting charge dissipation required for the cyclic operation. With a uniform dispersion of photoconductive particles a relatively high volume concentration of photoconductor material, about 50 percent by volume, is usually necessary to obtain sufficient photoconductor particle-to-particle contact for rapid discharge. This high photoconductive loading can result in destroying the physical continuity of the resinous binder, thus significantly reducing the mechanical properties thereof. Illustrative examples of specific binder materials disclosed in the '006 patent include polycarbonate resins, polyester resins, polyamide resins, and the like.

Many other patents are in existence describing photoresponsive devices including layered devices containing generating substances, such as U.S. Pat. No. 3,041,167, which discloses an overcoated imaging member with a conductive substrate, a photoconductive layer, and an overcoating layer of an electrically insulating polymeric material. This member is utilized in an electrophotographic copying method by, for example, initially charging the member with an electrostatic charge of a first polarity, and imagewise exposing to form an electrostatic latent image which can be subsequently developed to form a visible image. Prior to each succeeding imaging cycle, the imaging member can be charged with an electrostatic charge of a second polarity, which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

Photoresponsive imaging members with squaraine photogenerating pigments are also known, reference U.S. Pat. No. 4,415,639. In this patent there is illustrated an improved photoresponsive imaging member with a substrate, a hole blocking layer, an optional adhesive interface layer, an organic photogenerating layer, a photoconductive composition capable of enhancing or reducing the intrinsic properties of the photogenerating layer, and a hole transport layer. As photoconductive compositions for the aforementioned member there can be selected various squaraine pigments, including hydroxy squaraine compositions. Moreover, there is disclosed in U.S. Pat. No. 3,824,099 certain photosensitive hydroxy squaraine compositions. According to the disclosure of this patent, the squaraine compositions are photosensitive in normal electrostatographic imaging processes.

The use of selected perylene pigments as photoconductive substances is also known. There is thus described in Hoechst European Patent Publication Nos. 0040402, DE3019326, filed May 21, 1980, the use of N,N'-disubstituted perylene-3,4,9,10-tetracarboxyldiimide pigments as photoconductive substances. Specifically, there is disclosed in this publication evaporated N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, Journal of Applied Photographic Engineering, Vol. 4, No. 3, page 118 (1978). There is also disclosed in U.S. Pat. No. 3,871,882 photoconductive substances comprised of specific perylene-3,4,9,10-tetracarboxylic acid derivative dyestuffs. In accordance with the teachings of this patent the photoconductive layer is preferably formed by vapor depositing the dyestuff in a vacuum. Also, there is specifically disclosed in this patent dual layer photoreceptors with perylene-3,4,9,10-tetracarboxylic acid diimide derivatives, which have spectral response in the wavelength region of from 400 to 600 nanometers.

Moreover, there is disclosed in U.S. Pat. No. 4,419,427 electrographic recording mediums with a photosemiconductive double layer comprised of a first layer containing charge carrier perylene diimide producing dyes, and a second layer with one or more compounds which are charge transporting materials when exposed to light, reference the disclosure in column 2, beginning at line 20. Also of interest with respect to this patent is the background information included in columns 1 and 2, wherein perylene dyes of the formula illustrated are presented.

Furthermore, there is presented in copending application U.S. Ser. No. 587,483, now U.S. Pat. No. 4,514,482 entitled Photoconductive Devices Containing Perylene Dye Compositions, the disclosure of which is totally incorporated herein by reference, an ambipolar imaging member comprised of a supporting substrate, a photoconductive layer comprised of specific perylene dyes different than the perylene pigments of the present invention, which dyes are dispersed in a polymeric resinous binder composition; and as a top layer a specific aryl amine hole transporting substance dispersed in an inactive resinous binder. Examples of perylene dyes selected for the photoconductive layer of the copending application include N,N'-di(2,4,6-trimethylphenyl)-perylene 3,4,9,10-tetracarboxyldiimide, N,N'-di(2,4,6-trimethoxyphenyl)perylene 3,4,9,10-tetracarboxyldiimide, and N,N'-di(2,6-dimethylphenyl)perylene 3,4,9,10-tetracarboxyldiimide.

Additionally, there is disclosed in U.S. Pat. No. 4,429,029 electrophotographic recording members with perylene charge carrier producing dyes and a charge carrier transporting layer. The dyes selected, which are illustrated in column 2, beginning at line 55, are substantially similar to the photogenerating dyes of the present invention. The aryl amine hole transporting compounds selected for members of the present invention are, however, not described in the U.S. Pat. No. 4,429,029 patent; and further with the photoresponsive imaging members of the present invention the photogenerating perylene layers are prepared by vacuum deposition enabling superior image quality in comparison to the binder or binderless dispersed layers obtained by the spray coating or solution casting techniques as illustrated in the U.S. Pat. No. 4,429,029 patent. Vacuum deposition enables, for example, layers of uniform thickness and substantial smoothness, as contrasted to layers of ununiform thickness and surface roughness with binder or binderless dispersed layers prepared by spray coating processes; very thin layers of 0.1 microns or less are permitted whereas with binder or binderless dispersed layers, thicknesses are generally about 0.5 microns or more; and continuous layers with no large voids or holes result, while dispersed layers usually contain holes or voids thereby adversely affecting image resolution.

Furthermore, with the imaging members of the present invention comprised of vacuum deposited perylenes, and aryl amine holes transporting compounds superior xerographic performance occurs as low dark decay characteristics result and higher photosensitivity is generated, particularly in comparison to several prior art imaging members prepared by solution coating or spray coating, reference for example, U.S. Pat. No. 4,429,029 mentioned hereinbefore.

While the above-described photoresponsive imaging members are suitable for their intended purposes, there continues to be a need for improved members, particularly layered members, having incorporated therein specific perylene pigment compositions and aryl amine hole transport compounds. Additionally, there continues to be a need for layered imaging members comprised of specific aryl amine charge transport compositions; and as photogenerating materials perylene pigments with acceptable visible sensitivity, low dark decay characteristics, high charge acceptance values, and wherein these members can be used for a number of imaging cycles in a xerographic imaging or printing apparatus. Furthermore, there continues to be a need for photoresponsive imaging members which can be positively or negatively charged thus permitting the development of images, including color images, with positively or negatively charged toner compositions. Moreover, there continues to be an important need for disposable imaging members with nontoxic organic pigments. Also, there is a need for disposable imaging members useful in xerographic imaging processes, and xerographic printing systems wherein, for example, light emitting diodes (LED), helium cadmium, or helium neon lasers are selected; and wherein these members are particularly sensitive to the visible region of the spectrum, that is, from about 400 to about 800 nanometers.

SUMMARY OF THE INVENTION

It is an object of the present invention to provide improved photoresponsive imaging members which are substantially inert to the users thereof.

It is yet another object of the present invention to provide disposable layered photoresponsive imaging members.

A further specific object of the present invention resides in the provision of an improved photoresponsive imaging member with an aryl amine hole transport layer, and a photogenerator layer comprised of specific perylene pigment compositions.

In yet another specific object of the present invention there is provided negatively charged layered photoresponsive imaging members vacuum evaporated perylene pigment compositions optionally dispersed in a resinous binder, and thereon a hole transport layer comprised of aryl amine molecules.

There is provided in another object of the present invention positively charged layered photoresponsive imaging members with a top vacuum evaporated perylene pigment composition optionally dispersed in a resinous binder, and thereunder a hole transport layer comprised of aryl amine molecules.

It is still another object of the present invention to provide improved imaging members sensitive to light in the visible region of the spectrum, that is, from about 400 to about 800 nanometers.

It is yet another object of the present invention to provide imaging and printing methods with the improved photoresponsive imaging members illustrated herein.

These and other objects of the present invention are accomplished by the provision of photoresponsive imaging members having incorporated therein vacuum evaporated photogenerating layers comprised of known perylene pigment compositions selected from the group consisting of I. A Mixture of Cis and Trans Isomers of the Formulas

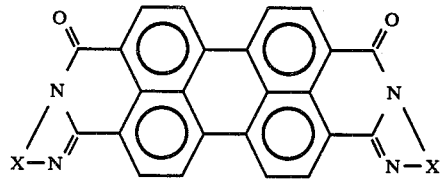

CIS

-continued

I. A Mixture of Cis and Trans Isomers of the Formulas

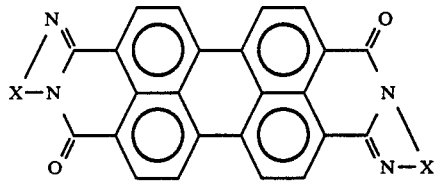

TRANS wherein X is o-phenylene, pyridimediyl, pyrimidinediyl, phenanthrenediyl, naphthalenediyl, and the corresponding methyl, nitro, chloro, and methoxy substituted derivatives; and II. Perylene Pigment Compound

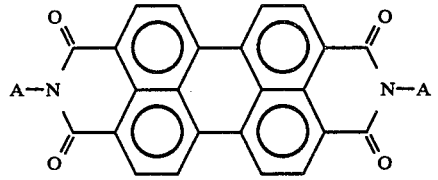

wherein A is hydrogen, lower alkyl of from 1 to about 4 carbon atoms, aryl, substituted aryl, arylalkyl, alkoxyalkyl, carboxylate, a heterocyclic group, alkoxyaryl; specific examples of which include methyl, ethyl, phenyl, methoxy, ethoxy, propoxy, pyrroles, furan, imidazole, esters, and quinolines.

Illustrative examples of perylene pigments useful for incorporation into the imaging members of the present invention include those of the following formulas:

III. Benzimidazole Perylenes

CIS

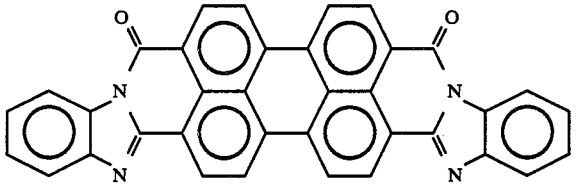

-continued

TRANS

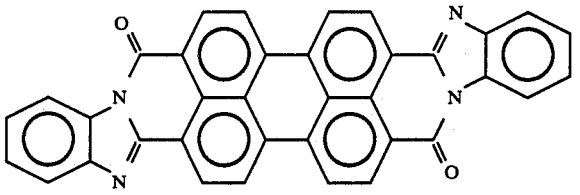

and

IV. N,N'—Diphenyl-3,4,9,10-Perylenebis(Dicarboximide)

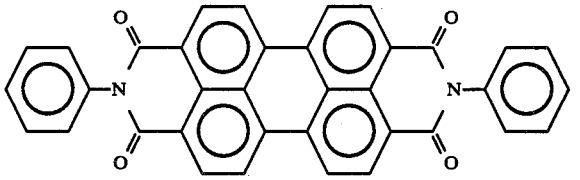

With further reference to the perylenes of formula III, the cis isomer can be chemically designated as bisbenzimidazo(2,1-a-1',1'-b)anthra(2,1,9-def:6,5,10-d'e'f')diisoquinoline-6,11-dione, while the trans isomer has the chemical designation bisbenzimidazo(2,1-a-1',1'-b)anthra(2,1,9-def:6,5,10-d'e'f')diisoquinoline-10,21-dione.

The known perylene compositions illustrated herein are generally prepared by the condensation reaction of perylene 3,4,9,10 tetracarboxylic acid or the corresponding anhydrides with an appropriate amine in quinoline, in the presence of a catalyst, and with heating at elevated temperatures, about 180° C. to about 230° C., the details of which are described in German Patent Publications Nos. 2,451,780; 2,451,781; 2,451,782; 2,451,783; 2,451,784; 3,016,765; French Patent No. 7723888; and British Patent Nos. 857,130; 901,694; and 1,095,196, the disclosure of each of the aforementioned publications and patents being totally incorporated herein by reference.

The following equation details the acid catalyzed condensation in acetic acid of 3,4,9,10-perylene tetracarboxylic dianhydride with the o-phenylene diamine enabling the cis-trans mixture of Formula III.

V. Cis-Trans Mixture of Benzimidazole Perylene Prepared by Reacting the Dianhydride With O—Phenylene Diamine

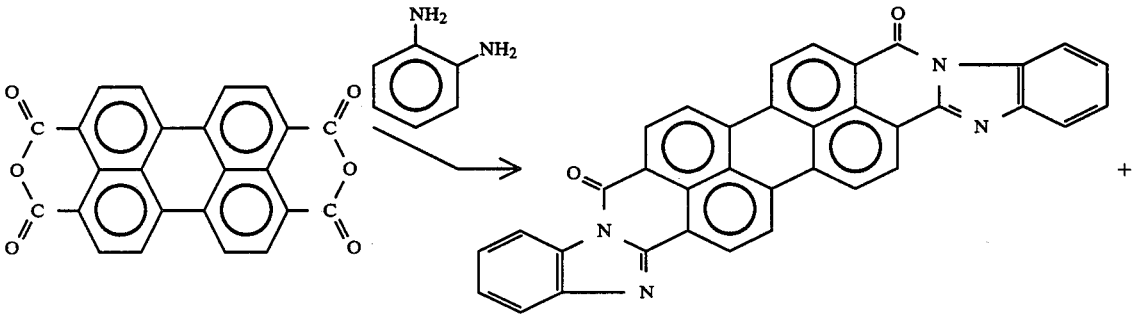

CIS

-continued

V. Cis-Trans Mixture of Benzimidazole Perylene Prepared by Reacting the Dianhydride With O—Phenylene Diamine

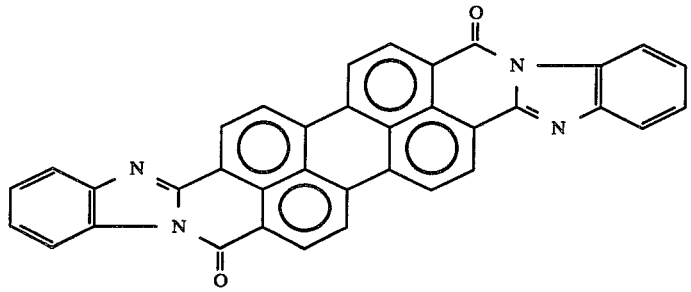

TRANS

Similarly, the perylene of Formula IV can be prepared by reacting perylene-3,4,9,10-tetracarboxylic dianhydride with aniline in accordance with the following equation:

VI. Dianhydride With An Aniline

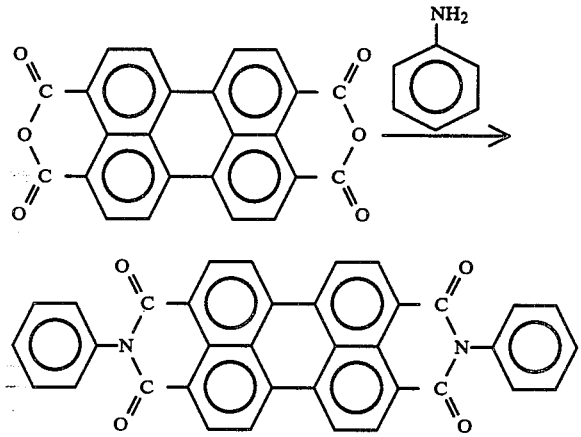

In one specific process embodiment, the perylene pigments of the present invention can be prepared by the condensation reaction of perylene-3,4,9,10-tetracarboxylic acid or its corresponding anhydrides with an amine in a molar ratio of from about 1:2 to about 1:10, and preferably in a ratio of from about 1:2 to about 1:3. This reaction is generally accomplished at a temperature of from about 180° C. to about 230° C., and preferably at a temperature of about 210° C. with stirring and in the presence of a catalyst. Subsequently, the desired product is isolated from the reaction mixture by known techniques such as filtration. Examples of reactants include perylene-3,4,9,10-tetracarboxylic acid, and perylene-3,4,9,10-tetracarboxylic acid dianhydride. Illustrative amine reactants include o-phenylene diamine 2,3-diaminonaphthalene; 2,3-diamino pyridine; 3,4-diamino pyridine; 5,6-diamino pyrimidene; 9,10-diamino phenanthrene; 1,8-diamino naphthalene; aniline; and substituted anilines.

Catalysts that can be used include known effective materials such as anhydrous zinc chloride, anhydrous zinc acetate, zinc oxide, acetic acid, hydrochloric acid, and the like.

Numerous different layered photoresponsive imaging members with the perylene pigments illustrated herein can be fabricated. In one embodiment, thus the layered photoresponsive imaging members are comprised of a supporting substrate, an aryl amine hole transport layer, and situated therebetween a vacuum evaporated photogenerator layer comprised of the perylene pigments illustrated hereinbefore. Another embodiment of the present invention is directed to positively charged layered photoresponsive imaging members comprised of a supporting substrate, an aryl amine hole transport layer, and as a top overcoating a vacuum evaporated photogenerator layer comprised of the perylene pigments illustrated hereinbefore. Moreover, there is provided in accordance with the present invention an improved negatively charged photoresponsive imaging member comprised of a supporting substrate, a thin adhesive layer, a photogenerator vacuum evaporated layer comprised of the perylene pigments illustrated herein optionally dispersed in a polymeric resinous binder, and as a top layer aryl amine hole transporting molecules dispersed in a polymeric resinous binder.

The improved photoresponsive imaging members of the present invention can be prepared by a number of methods, the process parameters and the order of coating of the layers being dependent on the member desired. Thus, for example, these imaging members are prepared by vacuum deposition of the photogenerator layer on a supporting substrate with an adhesive layer thereon, and subsequently depositing by solution coating the hole transport layer. The imaging members suitable for positive charging can be prepared by reversing the order of deposition of photogenerator and hole transport layers.

Imaging members having incorporated therein the perylene pigments of the present invention are useful in various electrostatographic imaging systems, particularly those conventionally known as xerographic processes. Specifically, the imaging members of the present invention are useful in xerographic imaging processes wherein the perylene pigments absorb light of a wavelength of from about 400 nanometers to about 800 nanometers. In these processes, electrostatic latent images are initially formed on the imaging member followed by development, and thereafter transferring the image to a suitable substrate.

Moreover, the imaging members of the present invention can be selected for electronic printing processes with gallium arsenide light emitting diodes (LED) arrays which typically function at wavelengths of 660 nanometers.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
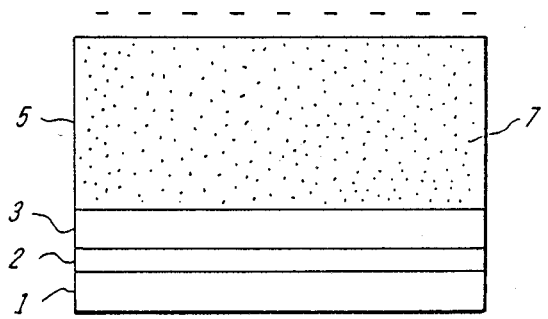
FIG. 1 is a partially schematic cross-sectional view of a negatively charged photoresponsive imaging member of the present invention.

Illustrated in FIG. 1 is a negatively charged photoresponsive imaging member of the present invention comprised of a substrate 1, an adhesive layer 2, a vacuum evaporated photogenerator layer 3, comprised of a mixture of the cis and trans isomers of bisbenzimidazo(2,1-a-1',2'-b)anthra(2,1,9-def:6,5,10-d'e'f')diisoquinoline-6,11-dione, and bis-benzimidazo(2,1-a:2',1'-a')anthra(2,1,9-def:6,5,10-d'e'f')diisoquinoline-10,21-dione; and a charge transport layer 5, comprised of N,N'-diphenyl-N,N'-bis(3-methylphenyl)-[1,1'-biphenyl]-4,4'-diamine, dispersed in a polycarbonate resinous binder 7.

Figure 2:
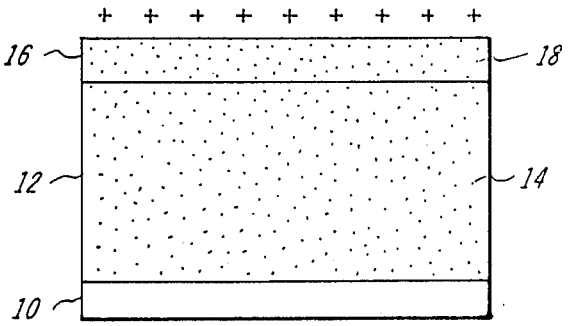
FIG. 2 is a partially schematic cross-sectional view of a positively charged photoresponsive imaging member of the present invention.

Illustrated in FIG. 2 is a positively charged photoresponsive imaging member of the present invention comprised of a substrate 10, a charge transport layer 12, comprised of N,N'-diphenyl-N,N'-bis(3-methylphenyl)-[1,1'-biphenyl]-4,4'-diamine, dispersed in a polycarbonate resinous binder 14, and a photogenerator layer 16, applied by vacuum evaporation, comprised of a mixture of the cis and trans isomers of bisbenzimidazo(2,1-a-1',2'-b)anthra(2,1,9-def:6,5,10-d'e'f')diisoquinoline-6,11-dione, and bis-benzimidazo(2,1-a:2',1'-a')anthra(2,1,9-def:6,5,10-d'e'f')diisoquinoline-10,21-dione, optionally dispersed in an inactive resinous binder 18.

Similarly, there is included within the present invention photoresponsive imaging members as described herein with reference to FIG. 1 with the exception that there can be selected as the photogenerator the perylene pigments N,N'-diphenyl-3,4,9,10-perylenebis(-dicarboximide), (Formula IV). Also envisioned are positively charged imaging members as described with reference to FIG. 2, with the exception that there is selected as the photogenerator perylene pigment N,N'-diphenyl-3,4,9,10-perylenebis(dicarboximide), (Formula IV).

Figure 3:
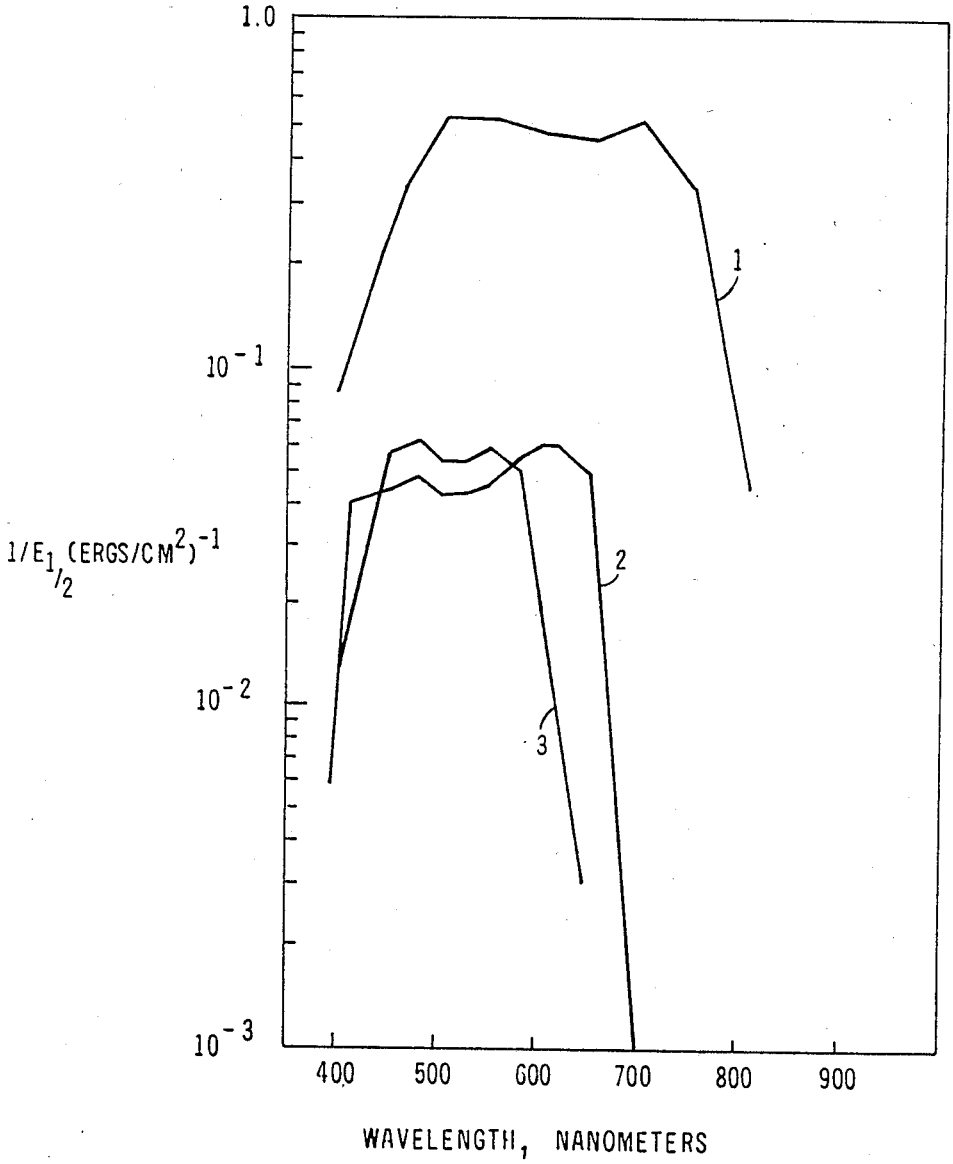
FIG. 3 is a line graph illustrating the spectral response of specific perylene pigments of the present invention.

Illustrated in FIG. 3 is a plot of the $E_{\frac{1}{2}}$ value versus wavelength in nanometers for photoresponsive imaging members prepared in accordance with Example III. Specifically, curve 1 represents the light sensitivity of the imaging member of Example III with a benzimidazole perylene of Formula III. This sensitivity is substantially greater than identical imaging members prepared by the procedure of Example III, with the exception that for curve 2 there was selected the prior art perylene N,N'-di(methoxypropyl)-3,4,9,10-perylenebis(dicarboxyamide); and for curve 3 the prior art perylene N,N'-dimethyl-3,4,9,10-perylenebis(dicarboxyamide) was selected instead of in each instance the benzimidazole of Formula III.

Figure 4:
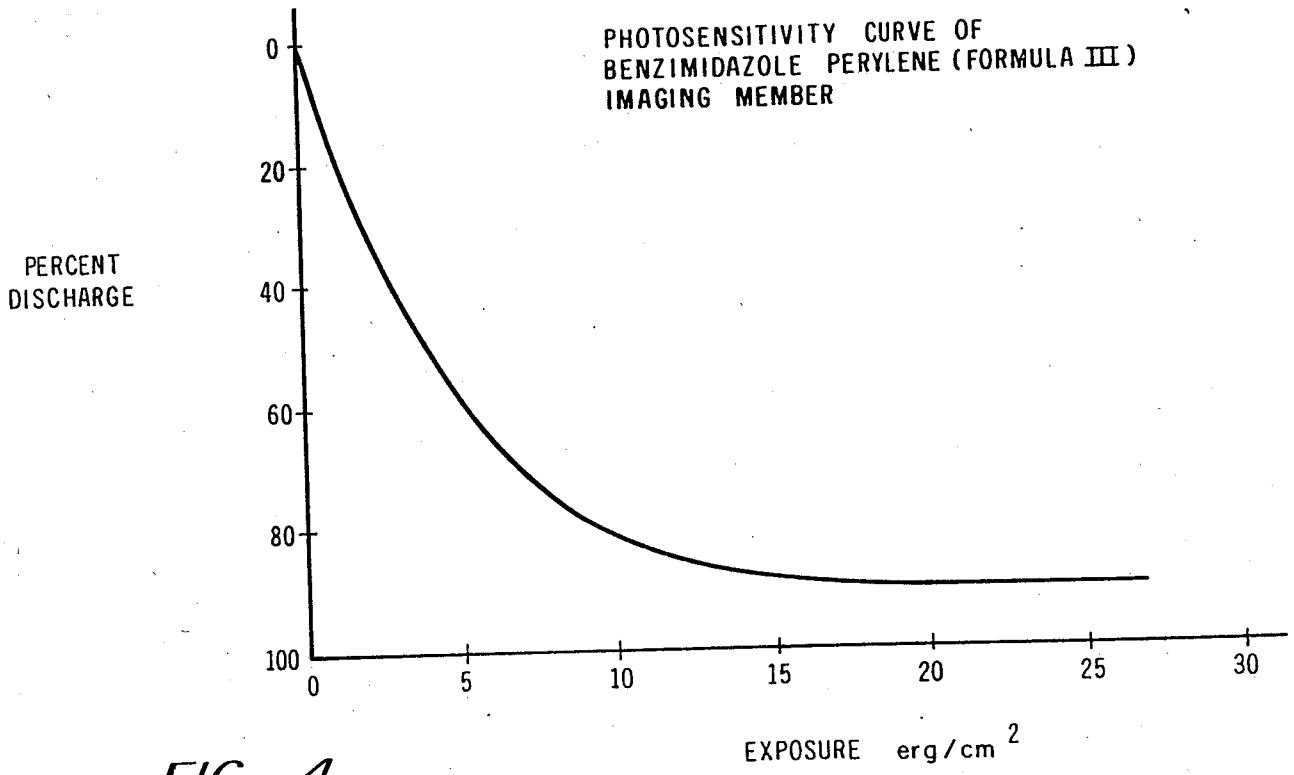
FIGS. 4 and 5 are photosensitivity curves for specific perylene pigments of the present invention.

FIG. 4 illustrates the photosensitivity curve for the imaging member of FIG. 1 the photogenerating layer indicated and wherein the percentage of discharge from an initial surface potential of −830 volts is plotted against the light exposure energies recited.

Figure 5:
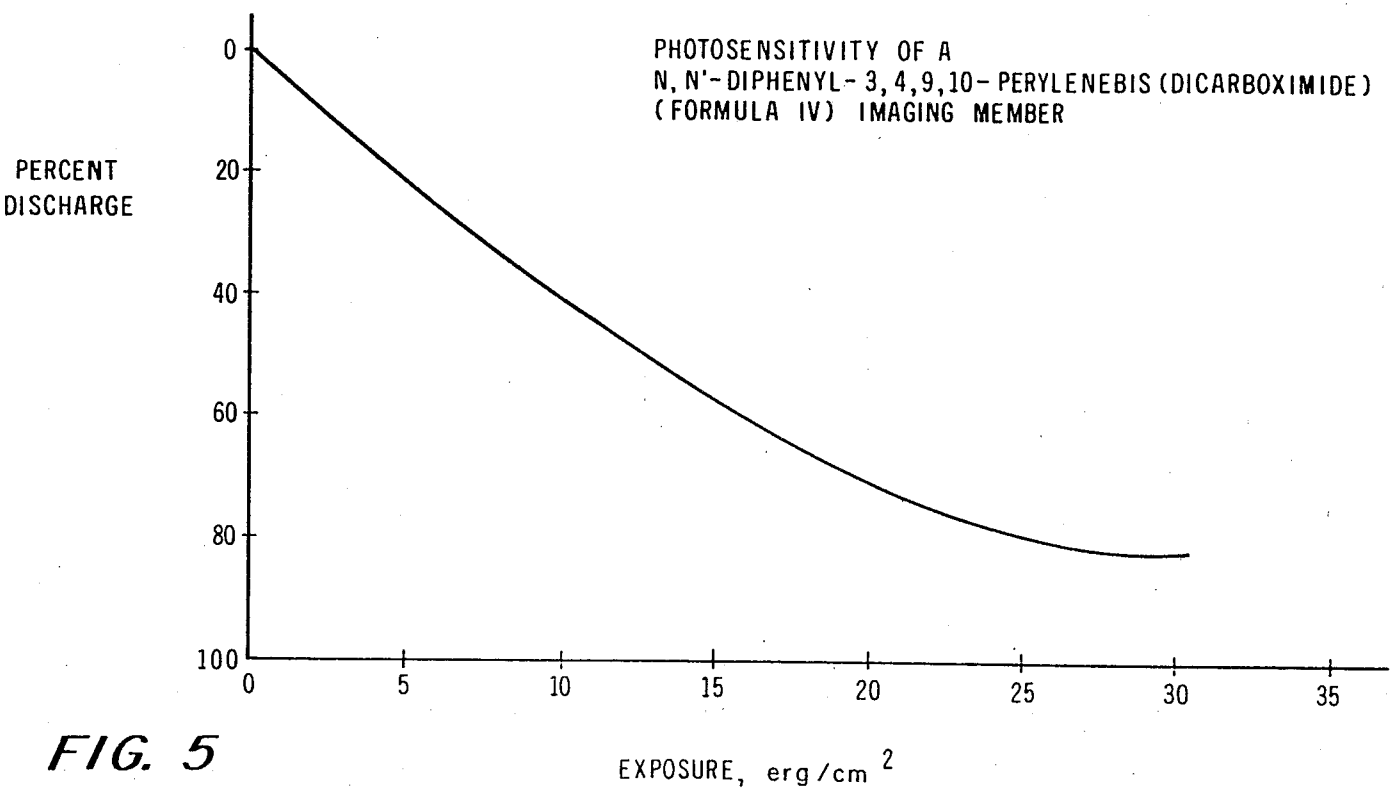

FIG. 5 illustrates a photosensitivity curve for the imaging member of FIG. 1 wherein the photogenerator layer is an evaporated film of the N,N'-diphenyl perylene (Formula IV) indicated.

Substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as Mylar a commercially available polymer; a layer of an organic or inorganic material having a semiconductive surface layer such as indium tin oxide, or aluminum arranged thereon, or a conductive material inclusive of aluminum, chromium, nickel, brass or the like. The substrate may be flexible or rigid and many have a number of many different configurations, such as, for example a plate, a cylindrical drum, a scroll, an endless flexible belt and the like. Preferably, the substrate is in the form of a seamless flexible belt. In some situations, it may be desirable to coat on the back of the substrate, particularly when the substrate is a flexible organic polymeric material, an anti-curl layer, such as for example polycarbonate materials commercially available as Makrolon.

The thickness of the substrate layer depends on many factors, including economical considerations, thus this layer may be of substantial thickness, for example, over 2,500 microns; or of minimum thickness providing there are no adverse effects on the system. In one preferred embodiment, the thickness of this layer ranges from about 75 microns to about 250 microns.

With further regard to the imaging members of the present invention, the photogenerator layer is preferably comprised of 100 percent of the perylene pigments disclosed herein. However, providing the objectives of the present invention are achieved, these perylene pigments can be dispersed in resinous binders. Generally, the thickness of the perylene photogenerator layer depends on a number of factors including the thicknesses of the other layers, and the percent mixture of photogenerator material contained in this layer. Accordingly, this layer can be of a thickness of from about 0.05 micron to about 10 microns when the photogenerator perylene composition is present in an amount of from about 5 percent to about 100 percent by volume. Preferably this layer is of a thickness of from about 0.25 micron to about 1 micron, when the photogenerator perylene composition is present in this layer in an amount of 30 percent by volume. In one very specific preferred embodiment, the vacuum deposited photogenerating layers are of a thickness of from about 0.07 micron to about 0.5 micron. The maximum thickness of this layer is dependent primarily upon factors such as photosensitivity, electrical properties and mechanical considerations.

Illustrative examples of polymeric binder resinous materials that can be selected for the photogenerator pigment include those polymers as disclosed in U.S. Pat. No. 3,121,006, the disclosure of which is totally incorporated herein by reference, polyesters, polyvinyl butyral, Formvar ®, polycarbonate resins, polyvinyl carbazole, epoxy resins, phenoxy resins, especially the commercially available poly(hydroxyether) resins, and the like.

As adhesives there can be selected various known substances inclusive of polyesters such as those commercially available from E. I. DuPont as 49,000 polyesters. This layer is of a thickness of from about 0.05 micron to 1 micron.

Arylamines selected for the hole transporting layer which generally is of a thickness of from about 5 microns to about 50 microns, and preferably of a thickness of from about 10 microns to about 40 microns, include molecules of the following formula:

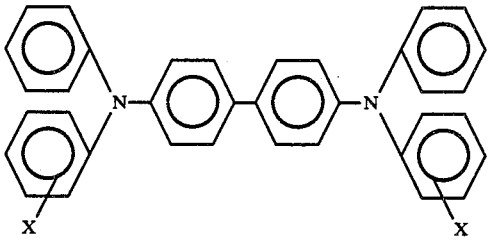

dispersed in a highly insulating and transparent organic resinous binder wherein X is an alkyl group or a halogen, especially those substituents selected from the group consisting of (ortho)$CH_3$, (para)$CH_3$, (ortho)Cl, (meta)Cl, and (para)Cl.

Examples of specific arylamines are N,N'-diphenyl-N,N'-bis(alkylphenyl)-[1,1-biphenyl]-4,4'-diamine wherein alkyl is selected from the group consisting of methyl such as 2-methyl, 3-methyl and 4-methyl, ethyl, propyl, butyl, hexyl, and the like. With chloro substitution, the amine is N,N'-diphenyl-N,N'-bis(halo phenyl)-[1,1'-biphenyl]-4,4'-diamine wherein halo is 2-chloro, 3-chloro or 4-chloro.

Examples of the highly insulating and transparent resinous material or inactive binder resinous material for the transport layers include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also, included within the scope of the present invention are methods of imaging with the photoresponsive devices illustrated herein. These methods generally involve the formation of an electrostatic latent image on the imaging member, followed by developing the image with a toner composition, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

Synthesis of benzimidazole perylene (Formula III)

There was mixed in a three-liter flask 5.85 grams of 3,4,9,10-perylenetetracarboxylic dianhydride, 26.77 grams of o-phenylene diamine and 7 milliliters of glacial acetic acid. The mixture resulting was then heated with stirring for 8 hours at 210° C., followed by cooling to room temperature. A solid product was then obtained by filtering the mixture throught a sintered glass funnel; followed by washing with 1,000 milliliters of methanol. Thereafter, the solid was slurried with 500 milliliters of 1 percent sodium hydroxide solution. After filtration, the solid was washed with 600 milliliters of water, and then was dried in an oven at 80° C. overnight yielding 7.62 grams, of the above product III.

EXAMPLE II

Synthesis of N,N'-diphenyl-3,4,9,10-perylenebis(dicarboximide) (Formula IV)

The procedure of Example I was repeated with the exception that the o-phenylene diamine reactant was replaced with 23.8 milliliters of aniline, yielding 7.0 grams of the above product IV.

EXAMPLE III

A photoresponsive imaging member was prepared by providing an aluminized Mylar substrate in a thickness of 75 microns, with a DuPont 49,000 polyester adhesive layer thereon in a thickness of 0.05 microns, and depositing thereover with a Varian Model 3117 vacuum coater a photogenerating layer of the benzimidazole perylene of Formula III at a final thickness of 0.1 microns. The photogenerator pigment was heated in a tantalum boat to about 350° C., and the vacuum coater evacuated to a pressure of about $10^{-5}$ torr. Also, the substrate was mounted 16 centimeters from the boat, and the photogenerator layer was deposited at a rate of about 4 Angstroms/sec.

Thereafter, the above photogenerating layer was overcoated with an amine charge transport layer prepared as follows:

A transport layer with 65 percent by weight Merlon, a polycarbonate resin, was mixed with 35 percent by weight N,N'-diphenyl-N,N'-bis(3-methylphenyl)-1,1'-biphenyl-4,4'-diamine, to 7 percent by weight in methylene chloride in an amber bottle. The resulting mixture was then coated in a dry thickness of 15 microns on top of the above photogenerating layer, using a multiple clearance film applicator (10 mils wet gap thickness). The resulting member was then dried in a forced air oven at 135° C. for 20 minutes.

The photosensitivity of this member was then determined by electrostatically charging the surface thereof with a corona discharge source until the surface potential, as measured by a capacitively coupled probe attached to an electrometer, attained an initial dark value $V_O$ of −800 volts. The front surface of the charged member was then exposed to light from a filtered Xenon lamp, XBO 75 watt source, allowing light in the wavelength range 400 to 800 nanometers to reach the member surface. The exposure causing reduction of the surface potential to half its initial value, $E_{\frac{1}{2}}$, and the percent discharge of surface potential due to various exposure energies was then determined. The photosensitivity can be determined in terms of the exposure in ergs/cm$^2$ necessary to discharge the member from the initial surface potential to half that value. The higher the photosensitivity, the smaller the exposure energy required to discharge the layer to 50 percent of the surface potential. The photosensitivity results are illustrated in FIG. 4 wherein the percent discharge of surface potential is plotted against various exposure energies. With white light, 400 to 800 nanometers exposure, the $E_{\frac{1}{2}}$ value was found to be 4.7 erg/cm$^2$, and the percent discharge at an exposure level of 10 erg/cm$^2$ was 74.

EXAMPLE IV

A photoresponsive imaging member was prepared by repeating the procedure of Example III with the exception that there was selected as the photogenerating pigment N,N'-diphenyl-3,4,9,10-perylenebis(dicarboximide) in the thickness of 0.1 micron. Thereafter, the photosensitivity of the resulting member was determined by repeating the procedure of Example III with the results of this determination being illustrated in FIG. 5. FIG. 5 is the percent discharge of surface potential plotted against various exposure energies. Specifically with further reference to FIG. 5, at a white light exposure of 400 to 700 nanometers, the $E_{\frac{1}{2}}$ was found to be 12 ergs/cm$^2$; and the percent discharge at an exposure level of 10 ergs/cm$^2$ was 41.

EXAMPLE V

A photoresponsive imaging member was prepared by repeating the procedure of Example III with the exception that there was selected as the photogenerating layer the benzimidazole perylene of Formula III in thickness of 0.1 and 0.25 microns respectively.

The photosensitivity of the resulting member was determined according to the procedure of Example III, with the following results:

| Thickness of Photogenerating Layer of Benzimidazole Perylene | $E_{\frac{1}{2}}$, erg/cm$^2$ | % Discharge at 10 erg/cm$^2$ |
|---|---|---|
| 0.1 microns | 4.7 | 74 |
| 0.25 microns | 4.1 | 81 |

The 0.25 micron member is slightly more sensitive than the 0.1 micron member. Compared with the imaging member of Example IV comprised of an N,N'-diphenyl-3,4,9,10-perylenebis(dicarboximide) photogenerating layer, the 0.25 micron member is about three times more sensitive, reference the $E_{\frac{1}{2}}$ values.

The higher sensitivity of imaging members containing the benzimidazole perylene photogenerator layer is attributed to the wider light absorption range of the benzimidazole perylene as compared to other perylenes.

Most perylenes only absorb light in the wavelength region ranging from 400 to 600 nanometers with a maximum absorption occurring at about 500 nanometers. However, the optical absorption spectrum of the Formula III benzimidazole film vacuum deposited onto a glass slide, evidences a broader absorption characteristic of from 400 to 800 nanometers with absorption peaks situated at 525 and 675 nanometers. The light absorption property beyond 600 nanometers enables the benzimidazole perylene to capture more light, especially from the white light generated in xerographic processes. Also, the benzimidazole perylene imaging element can be used in conjunction with a 630 nanometers He/Ne laser commonly used in electronic printing machines. Similarly, the benzimidazole perylene imaging element can be selected for use with GaAsP light emitting diode (LED) arrays operating at a wavelength of 660 nanometers in electronic printers.

EXAMPLE VI

The imaging member of FIG. 2 was prepared by repeating the procedure of Example III, with the exception that the amine transport layer was initially coated onto the aluminized Mylar substrate, followed by the photogenerator layer of benzimidazole perylene (Formula III), 0.07 microns. A second imaging member was then prepared by repeating the aforementioned procedure with the exception that the perylene layer had a thickness of 0.10 microns.

The photosensitivity of the two imaging members fabricated was then evaluated by repeating the procedure of Example III with the exception that the members were charged to a positive 800 volts, followed by exposure to white light. The photosensitivity results are summarized in the table.

| Thickness of Photogenerating Layer of Benzimidazole Perylene | $E_{\frac{1}{2}}$, erg/cm$^2$ | % Discharge at 10 erg/cm$^2$ |
|---|---|---|
| 0.07 microns | 27 | 21 |
| 0.10 microns | 31 | 22 |

EXAMPLE VII

Benzimidazole perylene, 17 grams, and 0.40 grams of Goodyear's PE200 polyester were mixed in a 30 cc glass bottle containing 70 grams of $\frac{1}{8}$ inch stainless steel shots and 13.5 grams of methylene chloride. The bottle was put on a roller mill and the mixture was milled for 24 hours. Thereafter, the polyester dispersion solution, 30 percent by weight of the perylene pigment, was then coated onto an aluminized Mylar substrate using a film applicator of 1 mil gap, followed by drying at 135° C. for 20 minutes. Subsequently, the transport layer was coated onto the generator layer according to the procedure described in Example I.

Similarly, a second binder layer was prepared as described before except that polyvinylcarbazole (PVK) was used to replace the PE200 polyester.

The following table compares the photosensitivity results of various imaging members, with the above binder generator layers, as compared to the vacuum deposited generator layers of Example IV. Equivalent amount of perylene are present in the three generator layer being compared.

| Type of Photogenerator Layer | $E_{\frac{1}{2}}$, erg/cm$^2$ | % Discharge at 10 erg/cm$^2$ |
|---|---|---|
| PE200 Binder | 8.0 | 60 |
| PVK Binder | 8.7 | 55 |
| 0.1 micron vacuum deposited | 4.7 | 74 |

The vacuum deposited benzimidazole perylene photogenerator layer evidences higher photosensitivity, reference a lower $E_{\frac{1}{2}}$ value and higher percent discharge at 10 erg/cm$^2$ than the binder layered imaging members.

Other modifications of the present invention may occur to those skilled in the art based upon a reading of the present disclosure and these modifications, including equivalents thereof, are intended to be included within the scope of the present invention.

What is claimed is:

1. An improved layered photoresponsive imaging member comprised of a supporting substrate; a vacuum evaporated photogenerator layer comprised of a perylene pigment selected from the group consisting of a mixture of bisbenzimidazo(2,1-a-1',2'-b)anthra(2,1,9-def:6,5,10-d'e'f')diisoquinoline-6,11-dione, and bisbenzimidazo(2,1-a:2',1'-a)anthra(2,1,9-def:6,5,10-d'e'f')diisoquinoline-10,21-dione; and N,N'-diphenyl-3,4,9,10-perylenebis(dicarboximide); and an aryl amine hole transport layer comprised of molecules of the following formula:

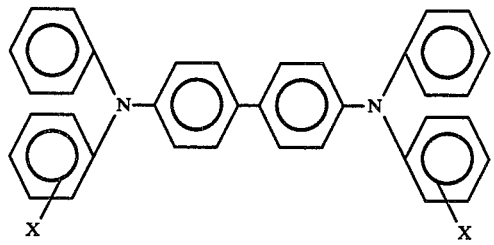

dispersed in a resinous binder and wherein X is selected from the group consisting of halogen and alkyl.

2. An imaging member in accordance with claim 1 wherein the supporting substrate is comprised of a conductive metallic substance, or an insulating polymeric composition overcoated with an electrically conductive layer.

3. An imaging member in accordance with claim 1 wherein the supporting substrate is aluminum.

4. An imaging member in accordance with claim 1 wherein the supporting substrate is overcoated with a polymeric adhesive layer.

5. An imaging member in accordance with claim 4 wherein the adhesive layer is a polyester resin.

6. An imaging member in accordance with claim 1 wherein X is selected from (ortho)$CH_3$, (meta)$CH_3$, (para)$CH_3$, (ortho)Cl, (meta)Cl, and (para)Cl.

7. An imaging member in accordance with claim 1 wherein the aryl amine is N,N'-diphenyl-N,N'-bis(3-methylphenyl)-[1,1'-biphenyl]-4,4'-diamine.

8. An imaging member in accordance with claim 1 wherein the resinous binder is a polycarbonate or polyvinylcarbazole.

9. An imaging member in accordance with claim 1 wherein the perylene pigments are dispersed in a resinous binder in an amount of from about 5 percent to about 95 percent by volume, and the aryl amine hole transport molecules are dispersed in a resinous binder in an amount of from about 10 to about 75 percent of weight.

10. An imaging member in accordance with claim 9 wherein the resinous binder for the perylene pigments is a polyester, polyvinylcarbazole, polyvinylbutyral, a polycarbonate, or a phenoxy resin; and the resinous binder for the aryl amine hole transport material a polycarbonate, a polyester, or a vinyl polymer.

11. An imaging member in accordance with claim 1 wherein the aryl amine hole transport layer is situated between the supporting substrate and the vacuum deposited photogenerating layer.

12. An imaging member in accordance with claim 11 comprised of a supporting substrate; a photogenerator layer comprised of a perylene pigment selected from the group consisting of a mixture of bisbenzimidazo(2,1-a-1',2'-b)anthra(2,1,9-def:6,5,10-d'e'f')diisoquinoline-6,11-dione, and bisbenzimidazo(2,1-a:2',1'-a)anthra(2,1,9-def:6,5,10-d'e'f')diisoquinoline-10,21-dione, and N,N'-diphenyl-3,4,9,10-perylenebis(dicarboximide); and an aryl amine hole transport layer.

13. An imaging member in accordance with claim 11 wherein the supporting substrate is comprised of a conductive metallic substance, or an insulating polymeric composition overcoated with an electrically conductive layer.

14. An imaging member in accordance with claim 11 wherein the supporting substrate is aluminum.

15. An imaging member in accordance with claim 11 wherein the supporting conductive substrate is overcoated with a thin polymeric adhesive layer.

16. An imaging member in accordance with claim 11 wherein the aryl amine charge transporting layer comprises molecules of the formula:

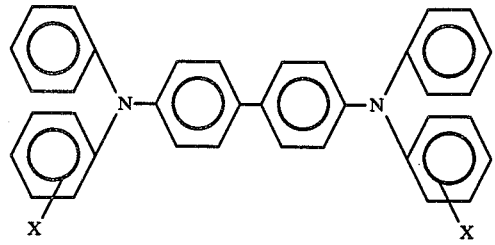

dispersed in a resinous binder and wherein X is selected from the group consisting of halogen and alkyl.

17. An imaging member in accordance with claim 16 wherein X is selected from (ortho)$CH_3$, (meta)$CH_3$, (para)$CH_3$, (ortho)Cl, (meta)Cl, and (para)Cl.

18. An imaging member in accordance with claim 16 wherein the aryl amine is N,N'-diphenyl-N,N'-bis(3-methylphenyl)-[1,1'-biphenyl]-4,4'-diamine.

19. An imaging member in accordance with claim 16 wherein the resinous binder is a polycarbonate or polyvinylcarbazole.

20. An imaging member in accordance with claim 16 wherein the perylene pigments are dispersed in a resinous binder in an amount of from about 5 percent to about 95 percent by volume, and the aryl amine hole transport molecules are dispersed in a resinous binder in an amount of from about 10 to about 75 percent by weight.

21. A method of imaging which comprises forming an electrostatic latent image on the imaging member of claim 1, causing development thereof with toner particles; subsequently transferring the developed image to a suitable substrate; and permanently affixing the image thereto.

22. A method of imaging which comprises forming an electrostatic latent image on the imaging member of claim 11, causing development thereof with toner particles; subsequently transferring the developed image to a suitable substrate; and permanently affixing the image thereto.

23. A method of imaging which comprises forming an electrostatic latent image on the imaging member of claim 12, causing development thereof with toner particles; subsequently transferring the developed image to a suitable substrate; and permanently affixing the image thereto.

24. A method of imaging which comprises forming an electrostatic latent image on the imaging member of claim 16 causing development thereof with toner particles; subsequently transferring the developed image to a suitable substrate; and permanently affixing the image thereto.

* * * * *